US010161645B2

(12) United States Patent
Suzuki et al.

(10) Patent No.: US 10,161,645 B2
(45) Date of Patent: Dec. 25, 2018

(54) LOCAL AIR CLEANING APPARATUS

(75) Inventors: Taketo Suzuki, Tokyo (JP); Tomoyuki Kakinuma, Tokyo (JP); Kozo Nitta, Tokyo (JP); Yuki Fujishiro, Tokyo (JP); Kazuma Fukiura, Tokyo (JP); Takahiro Sato, Tokyo (JP)

(73) Assignee: Koken Ltd., Tokyo (JP)

( * ) Notice: Subject to any disclaimer, the term of this patent is extended or adjusted under 35 U.S.C. 154(b) by 423 days.

(21) Appl. No.: 14/131,599

(22) PCT Filed: Jun. 22, 2012

(86) PCT No.: PCT/JP2012/066031

§ 371 (c)(1),
(2), (4) Date: Aug. 18, 2014

(87) PCT Pub. No.: WO2013/008610

PCT Pub. Date: Jan. 17, 2013

(65) Prior Publication Data

US 2014/0366498 A1 Dec. 18, 2014

(30) Foreign Application Priority Data

Jul. 8, 2011 (JP) ..... 2011-152338
May 8, 2012 (JP) ..... 2012-107029

(51) Int. Cl.
*F24F 7/06* (2006.01)
*F24F 3/16* (2006.01)
*F24F 9/00* (2006.01)

(52) U.S. Cl.
CPC ..... *F24F 7/06* (2013.01); *F24F 3/1607* (2013.01); *F24F 9/00* (2013.01)

(58) Field of Classification Search
CPC . B01D 46/13; F24F 7/06; F24F 3/1607; F24F 2013/608; F24F 2011/04; B08B 2215/003; Y10S 55/18; Y10S 55/29
(Continued)

(56) References Cited

U.S. PATENT DOCUMENTS 3,998,142 A 12/1976 Foreman et al.
4,023,472 A 5/1977 Grunder et al.
(Continued)

FOREIGN PATENT DOCUMENTS

JP 55-118754 9/1980
JP 57-28225 2/1982
(Continued)

OTHER PUBLICATIONS

Extended European Search Report dated Feb. 23, 2015 in App. No. 12 811 470.9.
(Continued)

*Primary Examiner* — Duane Smith
*Assistant Examiner* — Minh Chau T Pham
(74) *Attorney, Agent, or Firm* — Greer Burns & Crain Ltd.

(57) ABSTRACT

A local air cleaning apparatus (1) is provided with push hoods (2, 3) having an air flow opening face (23) for blowing out a cleaned uniform air flow and a pair of guides (4, 5) provided on sides of the push hoods (2, 3) having the air flow opening faces (23), the guides (4, 5) extending from the sides thereof having the air flow opening faces (23) toward downstream sides of the uniform air flows to form opening faces (41, 51) at downstream-side end portions of the guides. The push hoods (2, 3) are arranged such that the respective air flow opening faces (23) are opposed to each other. The opening faces (41, 51) of the guides (4, 5), are spaced apart from and opposed to each other to form an open region between the opening faces (41, 51) of the respective guides (4, 5). The cleaned uniform air flows blown out from the air flow opening faces (23) collide with each other in the open region to flow out of the open region so as to allow the insides of the guides (4, 5) and the inside of the open region to have higher cleanliness than other regions.

11 Claims, 7 Drawing Sheets

(58) Field of Classification Search
USPC ..... 55/385.2, 473, DIG. 18, DIG. 29; 98/115.3; 454/56, 187
See application file for complete search history.

(56) References Cited

U.S. PATENT DOCUMENTS

| | | | | |
|---|---|---|---|---|
| 4,927,438 | A * | 5/1990 | Mears | F24F 3/1607 454/56 |
| 5,326,316 | A | 7/1994 | Hashimoto et al. | |
| 5,487,768 | A | 1/1996 | Zytka et al. | |
| 6,113,486 | A | 9/2000 | Beudon et al. | |
| 6,632,260 | B1 * | 10/2003 | Siemers | B01D 46/0013 454/184 |
| 9,410,710 | B2 | 8/2016 | Suzuki et al. | |
| 2004/0198215 | A1 * | 10/2004 | Bridenne | F24F 3/1607 454/187 |
| 2008/0057851 | A1 | 3/2008 | Valkeapaa | |
| 2012/0297741 | A1 | 11/2012 | Reid et al. | |
| 2014/0366498 | A1 | 12/2014 | Suzuki et al. | |
| 2015/0059298 | A1 | 3/2015 | Suzuki et al. | |

FOREIGN PATENT DOCUMENTS

| | | |
|---|---|---|
| JP | 61-27435 | 2/1986 |
| JP | 63-176943 | 7/1988 |
| JP | 64-034420 | 2/1989 |
| JP | 03-080951 | 4/1991 |
| JP | 6-178907 | 6/1994 |
| JP | 09-057033 | 3/1997 |
| JP | 11-218355 | 8/1999 |
| JP | 2003-31451 | 1/2003 |
| JP | 2004-012038 | 1/2004 |
| JP | 2004-525337 | 8/2004 |
| JP | 2006-242419 | 9/2006 |
| JP | 2008-275266 | 11/2008 |
| JP | 2008275266 A * | 11/2008 |
| WO | WO 98/50134 | 11/1998 |
| WO | WO 2005/113169 | 12/2005 |
| WO | WO 2011/085735 A1 | 7/2011 |

OTHER PUBLICATIONS

Australian Examination Report No. 1 dated Mar. 6, 2015, in App. No. 2012281804.
Canadian First Examiner's Report dated Mar. 26, 2015, in App. No. 2,841,243.
Korean Office Action dated Apr. 16, 2015, in App. No. 10-2014-7000442.
Canadian Second Examiner's Report dated Jan. 14, 2016, in Canadian App. No. 2,841,243.
Australian Office Action for App. No. 2012281804 (counterpart application of U.S. Appl. No. 14/131,599) dated Mar. 5, 2015.
Australian Examination Report No. 1 dated Mar. 5, 2015, in App. No. 2012291379.
Canadian First Examiner's Report dated Mar. 26, 2015, in App. No. 2,842,895.
Korean Office Action dated Apr. 20, 2015, in App. No. 10-2014-7001854.
U.S. Appl. No. 14/234,737, filed Jan. 24, 2014.
Int'l. Search Report issued in Int'l. App. No. PCT/JP2012/066032, dated Aug. 28, 2012 (with translation).
Int'l. Search Report issued in Int'l. App. No. PCT/JP2012/066033, dated Sep. 4, 2012.
Translation of Informal Comment submitted to WIPO on Feb. 20, 2013.
Int'l. Search Report issued in Int'l. App. No. PCT/JP2012/066031, dated Aug. 28, 2012 (with translation).
Australian Examination Report dated Mar. 27, 2015 in App. No. 2012319869.
Canadian First Examiner's Report dated Apr. 2, 2015, in App. No. 2,850,285.
Korean Office Action dated Apr. 22, 2015 in App. No. 10-2014-7007201.
EESR for App. No. 12820022.7 (counterpart of U.S. Appl. No. 14/234,737) dated Feb. 23, 2015.
EESR for App. No. 12837874.2 (counterpart application of U.S. Appl. No. 14/347,330) dated Oct. 4, 2015.
Office action issued in U.S. Appl. No. 14/347,330 dated Feb. 4, 2016.

* cited by examiner

| | FLOW RATE(m／s) | GUIDE LENGTH(m) |
|---|---|---|
| EXAMPLE 2 | 0. 1 | 5. 5 |
| EXAMPLE 3 | 0. 5 | 4. 25 |
| EXAMPLE 4 | 0. 5 | 3. 25 |
| EXAMPLE 5 | 0. 7 | 4. 5 |
| EXAMPLE 6 | 0. 7 | 4. 0 |

LOCAL AIR CLEANING APPARATUS

TECHNICAL FIELD

The present invention relates to a local air cleaning apparatus.

BACKGROUND ART

Conventionally, a clean bench is often used as an apparatus for improving air cleanliness of a local work space. In a typical clean bench, only a front side of the work bench has an opening for performing work and sides thereof other than the front side form an enclosure in order to maintain cleanliness. In such a clean bench, a clean air outlet is arranged in the enclosure, and a worker puts his or her hands therein from the front opening for working to perform work.

However, the opening for working in the clean bench is narrow. Accordingly, for workers performing the assembly of precision instrument or the like, there is a problem with workability. In addition, as in a production line, when work involves the transfer of manufactured articles or manufacturing components, procedures such as arrangement of the entire line in the clean room have been taken. This is, however, problematic in terms of increasing the size of equipment.

Therefore, the present inventors proposed a local air cleaning apparatus in which air flow opening faces of a pair of push hoods capable of blowing out a uniform flow of cleaned air are arranged opposite to each other to cause collision of air flows from the respective air flow opening faces so as to allow a region between a pair of push hoods to be a clean air space having higher cleanliness than other regions (Patent Literature 1).

CITATION LIST

Patent Literature

Patent Literature 1: Unexamined Japanese Patent Application Kokai

SUMMARY OF INVENTION

Technical Problem

Meanwhile, depending on the kind of work and the procedures of work, it may be desirable in some cases to work in a little wider clean air space. Therefore, there has been a desire for a local air cleaning apparatus capable of forming a wider clean air space.

The present invention has been accomplished in view of the above problem, and it is an objective of the present invention to provide a local air cleaning apparatus capable of forming a wide clean air space.

Solution to Problem

In order to achieve the above objective, a local air cleaning apparatus according to a first aspect of the present invention comprises:

a pair of push hoods each comprising an air flow opening face for blowing out a cleaned uniform air flow and a pair of guides each provided on a side of each of the push hoods comprising the air flow opening face, each of the pair of guides extending from the side of the each push hood comprising the air flow opening face toward a downstream side of the uniform air flow to form an opening face at a downstream-side end portion of the each guide, wherein the pair of push hoods are arranged such that the respective air flow opening faces of the push hoods are opposed to each other;

the opening faces of the pair of guides are spaced apart from and opposed to each other so as to form an open region between the opening faces of the respective guides; and the cleaned uniform air flows blown out from the respective air flow opening faces collide with each other in the open region to flow out of the open region so as to cause the insides of the guides and the inside of the open region to have higher cleanliness than other regions.

A local air cleaning apparatus according to a second aspect of the present invention comprises:

a pair of push hoods each comprising an air flow opening face for blowing out a cleaned uniform air flow and a guide provided on a side of one of the pair of push hoods comprising the air flow opening face, the guide extending from the side of the one push hood comprising the air flow opening face toward a downstream side of the uniform air flow to form an opening face at a downstream-side end portion of the guide, wherein the pair of push hoods are arranged such that the respective air flow opening faces of the push hoods are opposed to each other;

the opening face of the guide is spaced apart from and opposed to the air flow opening face of the other push hood not provided with the guide, so as to form an open region between the opening face of the guide and the air flow opening face of the push hood not provided with the guide; and the cleaned uniform air flows blown out from the respective air flow opening faces collide with each other in the open region to flow out of the open region so as to cause the inside of the guide and the inside of the open region to have higher cleanliness than other regions.

In the local air cleaning apparatus according to the first aspect, preferably, the respective opening faces of the guides are of substantially the same shape.

In the local air cleaning apparatus according to the second aspect, preferably, the opening face of the guide and the air flow opening face of the push hood not provided with the guide are of substantially the same shape.

Preferably, the opening face of the guide and the air flow opening face of the push hood provided with the guide are of substantially the same shape.

Each of the pair of push hoods can comprise, for example, a plurality of push hoods connected together.

Preferably, the cleaned uniform air flows blown out from the air flow opening faces have a flow rate of 0.2 to 0.7 m/s.

Advantageous Effects of Invention

The present invention can form a wide clean air space.

DESCRIPTION OF EMBODIMENTS

Figure 1:
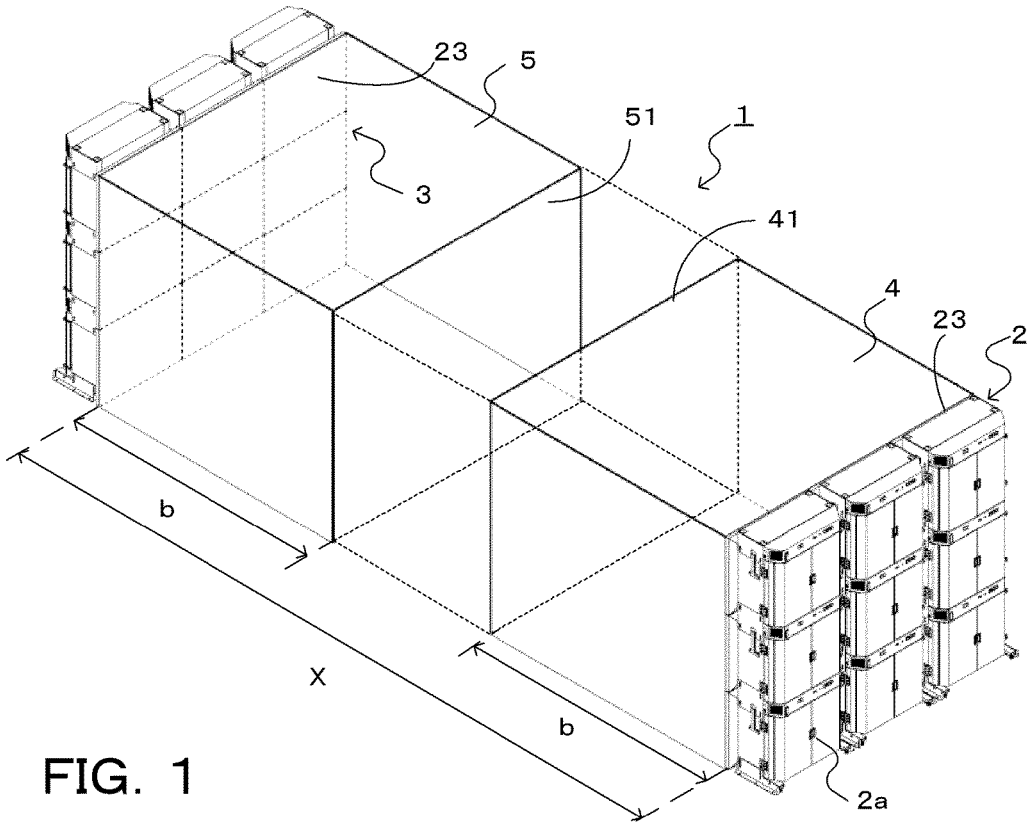
FIG. 1 is a view depicting a local air cleaning apparatus according to an embodiment of the present invention.

Hereinafter, a local air cleaning apparatus according to the present invention will be described with reference to the drawings. FIG. 1 is a view depicting an example of a local air cleaning apparatus according to an embodiment of the present invention.

As depicted in FIG. 1, a local air cleaning apparatus 1 of the present invention comprises a pair of push hoods 2 and 3 arranged so as to be opposed to each other and guides 4 and 5, respectively, provided on the respective push hoods 2 and 3.

The pair of push hoods 2 and 3 is not particularly limited as long as the push hoods have a mechanism for blowing out a cleaned uniform air flow. As a structure of each push hood, there can be employed a structure in which a cleaning filter is incorporated in a basic structure of a push hood conventionally used in push-pull ventilators.

The terms uniform air flow and uniform flow used herein have the same meaning as uniform flow described in "Industrial Ventilation" by Taro Hayashi (published by the Society of Heating, Air-Conditioning and Sanitary Engineers of Japan, 1982) and refer to a flow having a low air velocity, which is uniformly continuous and causes no large whirling portion. However, the present invention does not intend to provide an air blowout apparatus strictly specifying a flow rate of air and a velocity distribution. In the uniform air flow, for example, a variation in a velocity distribution in a state without obstacles is preferably within ±50%, and furthermore within ±30%, with respect to the average value.

Figure 2:
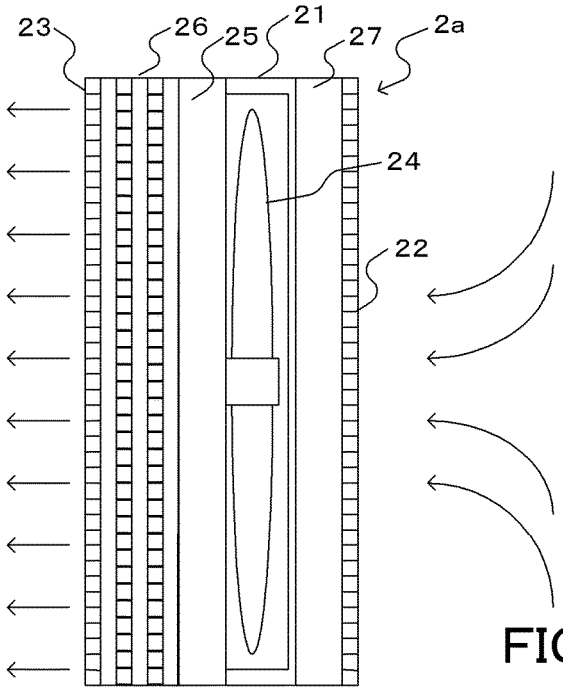
FIG. 2 is a view depicting the structure of a push hood.

In the push hoods 2 and 3 of the present embodiment, respective nine (longitudinal three pieces×transversal three pieces) push hoods are connected by a connector in such a manner that the air flow opening faces of the push hoods are oriented in the same direction and short sides and long sides, respectively, of the push hoods are arranged adjacent to each other. Herein, structures of the push hoods connected by the connector are basically the same. Accordingly, a description will be given of the structure of a push hood 2*a* as one of the push hoods, thereby describing the structures of the push hoods 2 and 3 of the present embodiment. FIG. 2 depicts the structure of the push hood 2*a*.

As depicted in FIG. 2, a housing 21 of the push hood 2*a* is formed into a substantially rectangular parallelepiped shape, and an air flow suction face 22 is formed on one surface of the housing 21. The air flow suction face 22 comprises, for example, a face having a plurality of holes formed entirely on the one surface of the housing 21. Through the holes, the air flow suction face 22 takes in an outside air or a room air, which is a surrounding air outside the push hood 2*a*. In addition, on the other surface of the housing 21 opposing the air flow suction face 22 is formed an air blowout face (an air flow opening face) 23. The air flow opening face 23 comprises, for example, a face with a plurality of holes formed entirely on the one surface of the housing 21. Through the holes, the air flow opening face 23 blows out the uniform air flow of a cleaned air formed in the push hood 2*a* to the outside of the push hood 2*a*. The dimensions of the air flow opening face 23 of the push hood 2*a* are not particularly limited, for example, 1050×850 mm.

Figure 3:
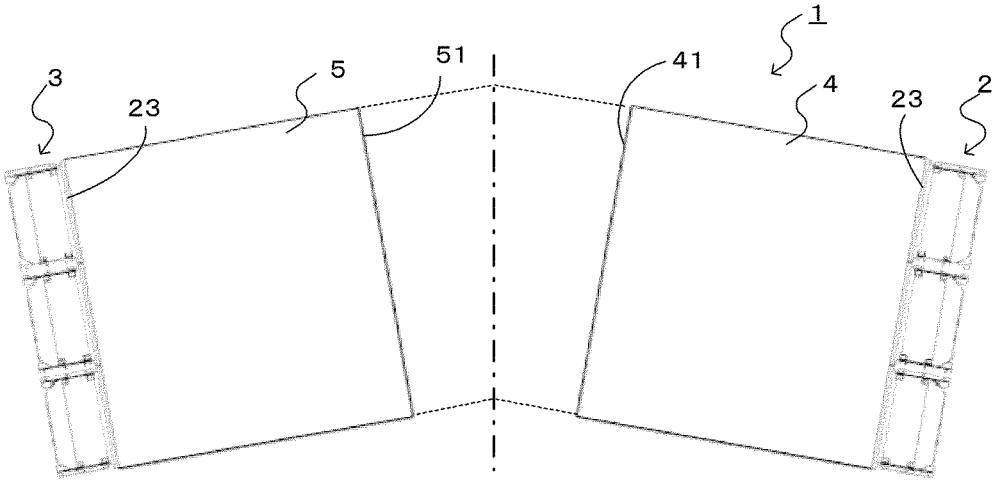
FIG. 3 is a view depicting another example of the local air cleaning apparatus.
Figure 7:
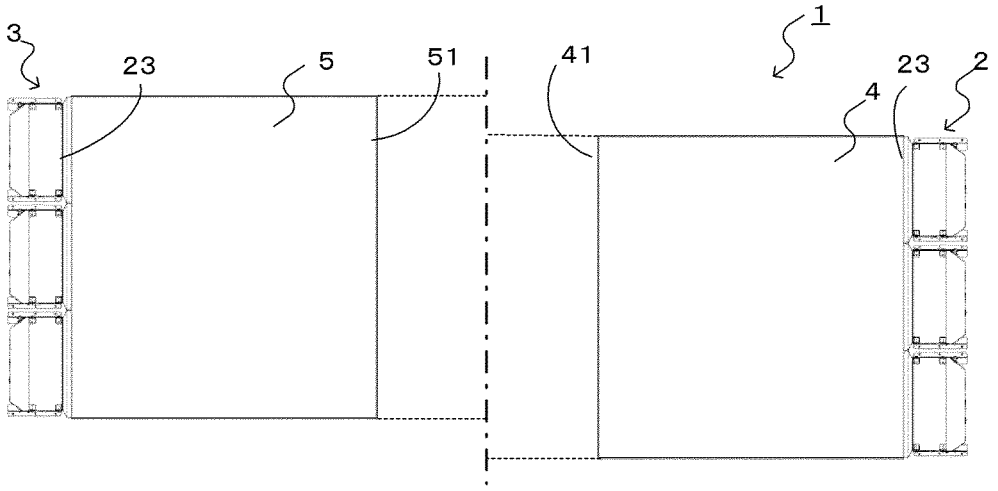
FIG. 7 is a view depicting another example of the local air cleaning apparatus.

The push hoods 2 and 3 are arranged such that the respective air flow opening faces 23 are opposed to each other. Herein, the description "the respective air flow opening faces 23 are opposed to each other" mean not only a state in which the respective air flow opening faces 23 of the push hoods 2 and 3 are opposed in parallel to each other, but also, for example, a state in which the air flow opening face 23 of the push hood 2 and the air flow opening face 23 of the push hood 3 are slightly inclined from each other, as depicted in FIG. 3. Regarding the inclination between the air flow opening face 23 of the push hood 2 and the air flow opening face 23 of the push hood 3, an angle formed by the respective air flow opening faces 23 is preferably in a range of about 10 degrees. In addition, as depicted in FIG. 7, a state in which while air flows blown out from the mutual opening faces collide head on with each other, the center axes of the air flows are tilted is also included in the state in which the respective air flow opening faces 23 are opposed to each other.

Inside the housing 21 are arranged an air blowing mechanism 24, a high performance filter 25, and a rectification mechanism 26.

The air blowing mechanism 24 is arranged on a side where the air flow suction face 22 is located in the housing 21. The air blowing mechanism 24 comprises an air suction fan and the like. The air blowing mechanism 24 takes in an outside air or a room air, which is the surrounding air of the push hood 2*a*, from the air flow suction face 22 and blows out an air flow from the air flow opening face 23. In addition, the air blowing mechanism 24 is configured to control a suction force of the fan so as to allow the flow rate of an air flow blown out from the air flow opening face 23 to be changed.

The high performance filter 25 is arranged between the air blowing mechanism 24 and the rectification mechanism 26. The high performance filter 24 comprises a high performance filter corresponding to a cleaning level, such as a HEPA filter (High Efficiency Particulate Air Filter), for filtrating the surrounding air taken in. The high performance filter 25 cleans the surrounding air taken in by the air blowing mechanism 24 into a clean air having a desirable cleaning level. The clean air cleaned to the desirable cleaning level by the high performance filter 25 is sent to the rectification mechanism 26 by the air blowing mechanism 24.

The rectification mechanism 26 is arranged between the high performance filter 25 and the air flow opening face 23. The rectification mechanism 26 is provided with a not-shown air resistor. The air resistor is a blown-air resistor for correcting a blown air having an amount of aeration biased with respect to an entire part of the air flow opening face 23 into a uniformized air flow (a uniform air flow) having an amount of aeration unbiased with respect to the entire part of the air flow opening face 23. The air resistor is formed using a punching plate, a mesh member, and/or the like. The rectification mechanism 26 corrects (rectifies) a clean air sent from the high performance filter 25 into a uniformized air flow (a uniform air flow) having an amount of aeration unbiased with respect to the entire part of the air flow opening face 23. The rectified uniform air flow is blown out by the air blowing mechanism 24 from the entire part of the air flow opening face 23 to the outside of the push hood 2.

In addition, as depicted in FIG. 2, the push hood 2*a* is preferably provided with a pre-filter 27 between the air flow suction face 22 and the air blowing mechanism 24 in the housing 21. An example of the pre-filter 27 may be a medium performance filter. The arrangement of the pre-filter 27 between the air flow suction face 22 and the air blowing mechanism 24 allows removal of relatively large dust particles contained in a surrounding air sucked into the housing 21 through the air flow suction face 22. In this manner, dust particles can be removed in multiple stages in accordance with the size of dust particles contained in the surrounding air. Accordingly, the performance of the high performance filter 25 easily causing clogging or the like can be maintained for a long period.

In the push hood 2*a* thus formed, the surrounding air taken in by the air blowing mechanism 24 is cleaned into a clean air having a desirable cleaning level by the pre-filter 27 and the high performance filter 25. Then, the clean air obtained by the cleaning is rectified into a uniform air flow by the rectification mechanism 26. The uniform air flow thus cleaned is blown out externally from the entire part of the air flow opening face 23 in a direction substantially vertical to the air flow opening face 23 of the push hood 2*a*.

One ends of the guides 4 and 5 are provided on sides of the push hoods 2 and 3 having the air flow opening faces 23. In addition, the guides 4 and 5 are provided on the air flow opening faces 23 and formed in such a manner as to extend therefrom toward downstream sides of uniform air flows blown out from the air flow opening faces 23 and cover outer peripheral outline portions of the air flow opening faces 23. For example, when the air flow opening faces 23 are rectangular, the guides 4 and 5 are formed to be extended so as to have a U-shape. With an open side of the U-shape and a floor, each of the guides 4 and 5 including the outer peripheral outline portion in a blowout direction of the uniform air flow surrounds, like a tunnel, the periphery of the air flow in parallel to a stream of the uniform air flow blown out therefrom. Additionally, when there is no floor, the guides 4 and 5 are formed to be extended so as to have, for example, square shapes, not U-shapes. These guides 4 and 5 are formed so as to have an open region between the respective other ends (the opening faces 41 and 51). Herein, the opening faces 41 and 51 of the guides 4 and 5 refer to hollow end faces, namely openings, which are surrounded by peripheral edge outlines of downstream-side end portions (boundaries with the open region) of the guides 4 and 5 extending like the tunnel toward the downstream sides of the uniform air flows blown out from the air flow opening faces 23. For example, in a case of substituting the floor for a part of the guides 4 and 5, when the cross sections of the guides 4 and 5 are U-shaped, square hollow openings formed by the downstream-side end portions of the guides 4 and 5 and the floor correspond to the opening faces 41 and 51. When the cross sections of the guides 4 and 5 are square shaped, square hollow openings formed at the downstream-side end portions of the guides 4 and 5 correspond to the opening faces 41 and 51.

The guides 4 and 5 can be formed using an arbitrary material as long as air flows blown out from the opening faces 41 and 51 can maintain the state of cleaned uniform air flows blown out from the air flow opening faces 23. In addition, the guides 4 and 5 do not necessarily have to completely cover the entire peripheries of the uniform air flows as long as the state of the cleaned uniform air flows blown out from the air flow opening faces 23 can be maintained. For example, a hole may be opened or a slit may be formed, partially in the guides 4 and 5.

Figure 4:
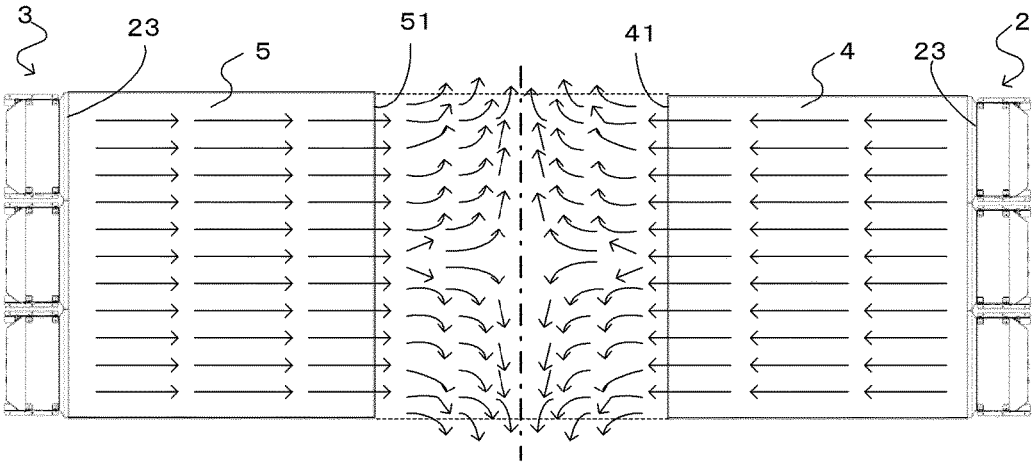
FIG. 4 is a view illustrating the stream of a cleaned uniform air flow.

Preferably, the opening faces 41 and 51 are formed so as to have substantially the same shape. When the uniform air flows collide head on with each other, the mutual air flows do not intermingle with each other and exhibit a behavior of substantially vertically changing the directions of the flows, as depicted in FIG. 4. The air flows flow as if there were a wall there. By flowing in such a manner, the air flows, after colliding with each other, flow outside a face where the collision occurred. As a result, a clean space can be obtained in a region from, as a center, the collision face of the mutual air flows to the end portions of the mutual opening faces. By making the shape of the opening face 41 substantially the same as the shape of the opening face 51, the face where an air flow blown out from the opening face 41 collides with an air flow blown out from the opening face 51 has substantially the same size as the size of faces where the mutual air flows flow.

Figure 5:
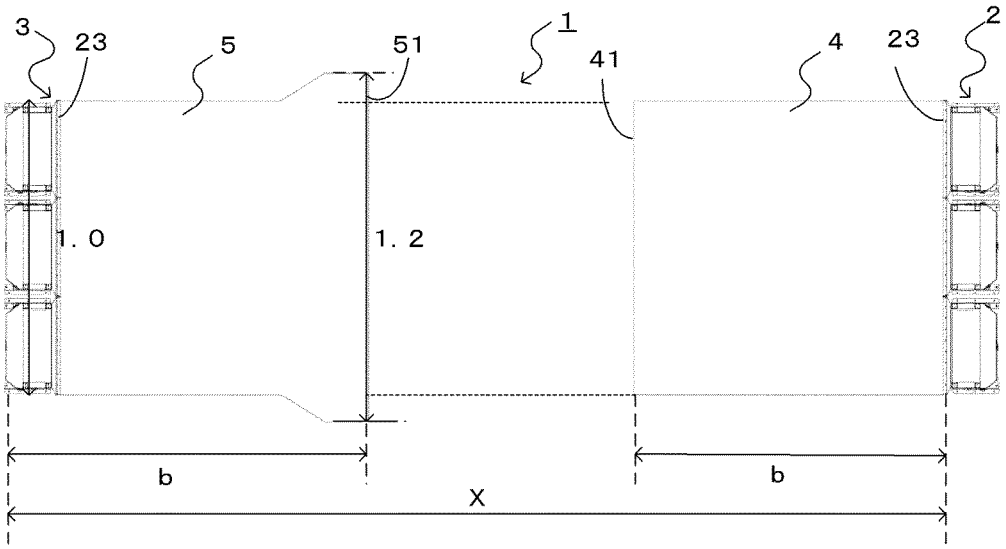
FIG. 5 is a view depicting another example of the local air cleaning apparatus.
Figure 6:
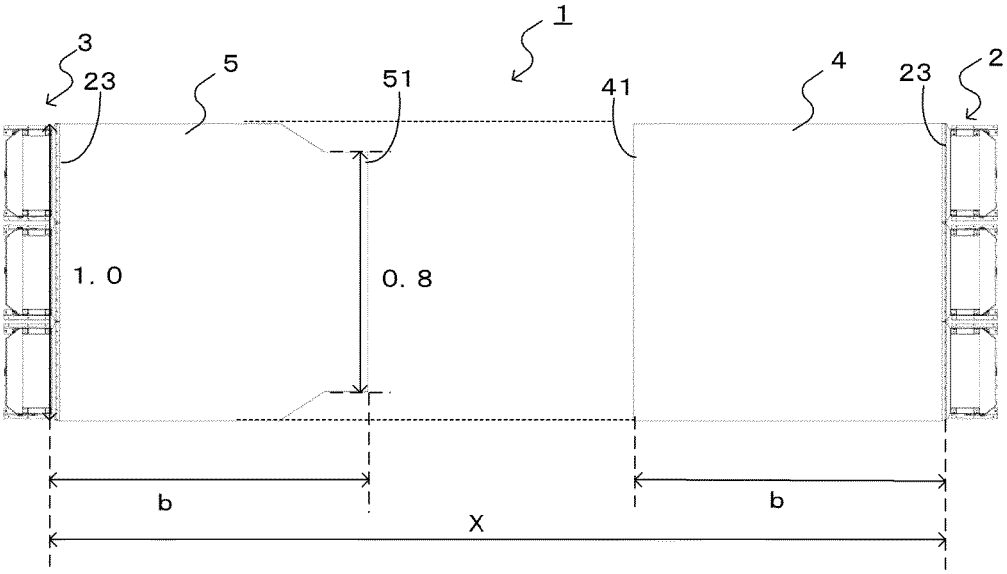
FIG. 6 is a view depicting another example of the local air cleaning apparatus.

However, the shapes of the opening faces 41 and 51 do not necessarily have to be substantially the same as each other. For example, as depicted in FIG. 5, the opening face 51 may be formed to be enlarged so as to be larger than the opening face 41. Alternatively, as depicted in FIG. 6, the opening face 51 may be formed to be reduced in size so as to be smaller than the opening face 41. Even in these cases, a clean space can be obtained in a region from, as the center, the face where an air flow blown out from the opening face 41 collides with an air flow blown out from the opening face 51 to the end portions of the mutual opening faces.

For example, as depicted in FIGS. 5 and 6, when making the shapes (areas) of the opening faces 41 and 51 different from each other by enlarging or reducing the width of the opening face 51, (width of opening face 51)/(width of air flow opening face 23) is preferably 0.6 to 1.4 and more preferably 0.8 to 1.2. Setting the width ratio of the opening faces in the range does not extremely reduce the area for air flow collision when the air flows blown out from the opening faces 41 and 51 collide with each other, so that there can be obtained a clean space sufficient to work.

In addition, preferably, the shapes of the opening faces 41 and 51 are formed to be substantially the same as the shapes of the air flow opening faces 23. This is because, by making the shapes of the opening faces 41 and 51 substantially the same as those of the air flow opening faces 23, the state of the uniform air flows blown out from the air flow opening faces 23 can be easily maintained in the opening faces 41 and 51. However, the shapes of the opening faces 41 and 51 do not necessarily have to be substantially the same as those of the air flow opening faces 23. For example, as depicted in FIGS. 5 and 6 described above, the width of the opening face 51 may be increased or reduced to make the shape of the opening face 51 different from the shape of the air flow opening face 23, because, even in this case, the state of the uniform air flow can be maintained. When increasing or reducing the width of the opening face 51, (width of opening face 51)/(width of air flow opening face 23) is preferably 0.6 to 1.4 and more preferably 0.8 to 1.2. This is because setting the width ratio in the range allows the state of the uniform air flow blown out from the air flow opening face 23 to be maintained in the opening face 51.

The guides 4 and 5 are arranged such that the opening faces 41 and 51 are opposed to each other. This is because arranging the guides 4 and 5 such that the opening faces 41 and 51 are opposed to each other allows the mutual air flows to collide head on with each other. Herein, the description "the opening faces 41 and 51 are opposed to each other" means not only a state in which the opening faces 41 and 51 are opposed parallel to each other, but also, for example, a state in which, as depicted in FIG. 3, the opening face 41 of the guide 4 and the opening face 51 of the guide 5 are slightly inclined from each other. This is because even when air flows blown out from the mutual opening faces 41 and 51 do not collide head on, a clean space can be formed in a space surrounded by dotted lines in FIG. 3. An inclination between the opening face 41 of the guide 4 and the opening face 51 of the guide 5 (an angle formed by the respective air flow opening faces 23) is preferably within a range of about 10 degrees. In addition, as depicted in FIG. 7, even when air flows blown out from the mutual opening faces 41 and 51 collide head on but the center axes thereof are misaligned, a clean space can also be formed in a region from, as the center, the face where the mutual air flows collide with each other to the end portions of the mutual opening faces.

A length b of the guide 4 and 5 can be any length as long as an open region can be formed between the opening faces 41 and 51 of the guides 4 and 5 by spacing the opening faces 41 and 51 apart from each other and opposing to each other. The length b of the guides 4 and 5 is preferably a predetermined length in accordance with a distance X between the air flow opening face 23 of the push hood 2 and the air flow opening face 23 of the push hood 3, the flow rates of the uniform air flows blown out from the air flow opening faces 23 (the opening faces 41 and 51), and the like. For example, when the distance X between the air flow opening face 23 of the push hood 2 and the air flow opening face 23 of the push hood 3 is 12 m, the length b of the guides 4 and 5 is preferably 4 m or more, for example, 4 to 5.75 m, at a flow rate of the uniform air flow of 0.7 m/s. In addition, when the distance X is 12 m, the length b of the guide 3 is, preferably, 3.25 to 5.75 m at a flow rate of the uniform air flow of 0.5 m/s, 5 to 5.75 m at 0.2 m/s, and 5.5 to 5.75 m at 0.1 m/s.

The guides 4 and 5 thus formed are, as depicted in FIG. 1, provided (attached) from the sides of the push hoods 2 and 3 having the air flow opening faces 23 toward the respective downstream sides of the uniform air flows and arranged such that the opening faces 41 and 51 provided at the downstream-side end portions of the guides are opposed to each other. In this manner, the open region is formed between the opening faces 41 and 51.

In the local air cleaning apparatus 1 thus formed, a surrounding air near the air flow suction face 22 taken in by the air blowing mechanism 24 of each of the push hoods 2 and 3 is cleaned by the pre-filter 27 and the high performance filter 25 into a clean air having a desirable cleaning level. Then, the clean air obtained by the cleaning is rectified into a uniform air flow by the rectification mechanism 26 and the cleaned uniform air flow is blown out into each of the guides 4 and 5 from the entire part of the air flow opening face 23.

Herein, the cleaned uniform air flows blown out from the air flow opening faces 23 have a flow rate of preferably 0.7 m/s or less, more preferably 0.5 m/s or less, still more preferably 0.4 m/s or less, and most preferably 0.2 to 0.1 m/s. This is because when blown out at these flow rates, the cleaned uniform air flows blown out from the air flow opening faces 23 move in such a manner as to be extruded through the insides of the guides 4 and 5 and the state of the uniform air flows is easily maintained in the guides 4 and 5. Furthermore, slowing the flow rate can suppress noise level and power consumption and also can reduce loads on the pre-filter 27 and the high performance filter 25. On the other hand, in a situation in which contaminants are generated in the cleaned space of the guide 4 or 5, the contaminants in the guide can be more quickly removed at a flow rate of the uniform air flow of about 0.5 m/s than at a flow rate thereof of 0.2 m/s. Thus, according to the purpose of use, the flow rate of the uniform air flow can be freely determined.

The cleaned uniform air flow blown out in the guide 4 passes through the guide 4 while maintaining the state of the uniform air flow, and is blown out from the opening face 41. In addition, the cleaned uniform air flow blown out in the guide 5 passes through the guide 5 while maintaining the state of the uniform air flow, and is blown out from the opening face 51.

The air flow blown out from the opening face 41 collides with the air flow blown out from the opening face 51 in the open region formed between the respective opening faces. The air flows having collided flow outside the open region (outside the local air cleaning apparatus 1). As a result, the region between the air flow opening faces 23 (the inside of the guide 4, the inside of the guide 5, and the open region between the opening faces 41 and 51) can have higher cleanliness than regions outside the local air cleaning apparatus 1.

Herein, a comparison was made between the present invention and the local air cleaning apparatus described in Patent Literature 1. For the comparison, dimensions of the air flow opening faces of the push hoods in both apparatuses were set to a width of 1050 mm and a height of 850 mm, and respectively, nine push hoods (longitudinal three pieces× transversal three pieces) each having the air flow opening face were connected together and opposed to each other. In this case, in the local air cleaning apparatus described in Patent Literature 1, it was confirmed that the open region was a clean air space until the distance between the air flow opening faces 23 reached about 5.5 m. In contrast, in the local air cleaning apparatus 1 of the present invention, when an open region is provided by attaching respective guides having a length of 3.25 m, from the air flow opening faces toward the downstream sides, to the outer peripheral outline portions of the pair of push hoods opposed to each other, in which each push hood includes nine push hoods having the same structure as those in Patent Literature 1 described above and connected together, and setting the distance between the opening faces 41 and 51 to 5.5 m, like the distance between the air flow opening faces of the pair of push hoods in Patent Literature 1 described above, the clean air space corresponds to a sum of the open region between the opening faces 41 and 51 and the distance from the air flow opening faces of the pair of push hoods to the opening faces of the respective guides. In other words, the distance 12 m between the air flow opening faces 23 is the clean air space. Accordingly, the local air cleaning apparatus 1 of the present invention can form a wide clean air space.

In addition, compared to an open-type air cleaning apparatus using the technology described in Patent Literature 1, even when air velocities of uniform air flows blown out from the push hoods having the same area are the same, the present invention can provide a considerably wider clean air space. Thus, even when the power consumptions of the push hoods 2 and 3 are the same, the amount of electricity consumed per unit area in the clean air space can be reduced. Or when cleaning of the same clean space, air velocity can be slower than in Patent Literature 1, enabling the power consumption to be reduced. Then, reduction in the air velocity can also reduce noise due to the operation of the local air cleaning apparatus, as well as can suppress the exhaustion of the filters for obtaining a clean air. Additionally, when the open-type local air cleaning apparatus of Patent Literature 1 was installed under the above conditions, it was confirmed that power consumption was 7200 W and noise level was 75 dB(A) in the center between the air flow opening faces 23 opposed to each other. In contrast, when the apparatus of the present invention was used under the above installation conditions (the distance between the air flow opening faces 23: 22 m; each guide length: 10 m), power consumption and noise level in the center between the air flow opening faces 23 were confirmed to be equivalent to those in the apparatus of Patent Literature 1. In other words, in Patent Literature 1, a space with a volume of about 45 cubic meters was cleaned and the amount of electricity consumed for cleaning per cubic meter was about 160 W, whereas the apparatus of the present invention was confirmed to have cleaned a space with a volume of about 177 cubic meters and the amount of electricity consumed for cleaning per cubic meter was confirmed to be about 41 W. Additionally, although the present invention described above has exemplified the case in which the distance between the air flow opening faces 23 is 22 m, increasing the distance can lead to further reduction in the power consumption per unit volume.

Furthermore, in a typical clean room, the entire room is cleaned and it is therefore not easy to perform construction work, whereas in the local air cleaning apparatus 1 of the present embodiment, the pair of push hoods 2 and 3 can be easily moved. In addition, the local air cleaning apparatus 1 of the embodiment can significantly facilitate layout changes in the work region, such as bending the guides 4 and 5 provided on the push hoods 2 and 3 depending on the work in a range that does not affect uniform air flows, removing the guide of one of the push hoods, and moving an open region formed between the opening faces of the guides to an arbitrary position.

In addition, in the case of a typical clean room in which a worker himself or herself enters a clean region to perform work, a work region for the worker is not changed no matter how much distance between a floor on which the worker works and a ceiling with a clean air blowing apparatus is increased. However, in the local air cleaning apparatus 1, a horizontal flow is used. Thus, increases of regions in the guides 4 and 5 can lead to an increase of a work region (floor area) for the worker himself or herself entering the clean region to perform work.

Additionally, in the open region of the present embodiment, there are no doors that allow a worker, a component, and a manufacturing machine to pass through, necessary in a typical clean room. Thus, cleanliness reduction in the clean air region caused by opening of the doors does not occur and going in-and-out of a worker and carrying-in and -out of a component or the like can be always done through the open region. In addition, even if the insides of the guides 4 and 5 and the inside of the open region are contaminated, cleaning can be performed in a significantly short time, although it takes a couple of hours to perform cleaning in a typical clean room.

As described above, according to the local air cleaning apparatus 1 of the present embodiment, the arrangement of the guides 4 and 5 allows the inside of the guide 4, the inside of the guide 5, and the open region between the opening faces 41 and 51 to have higher cleanliness than regions outside the local air cleaning apparatus 1, so that a wide clean air space can be formed.

The present invention is, however, not limited to the above embodiment and various modifications and applications can be made. Hereinafter, a description will be given of other embodiments applicable to the present invention.

While the present invention has been described with reference to the above embodiment exemplifying the case in which the guides 4 and 5 are of the same length, the lengths of the guides 4 and 5 may be different. Even in this case, the inside of the guide 4, the inside of the guide 5, and the open region between the opening faces 41 and 51 can have higher cleanliness than regions outside the local air cleaning apparatus 1, thus allowing the formation of a wide clean air space.

Figure 8:
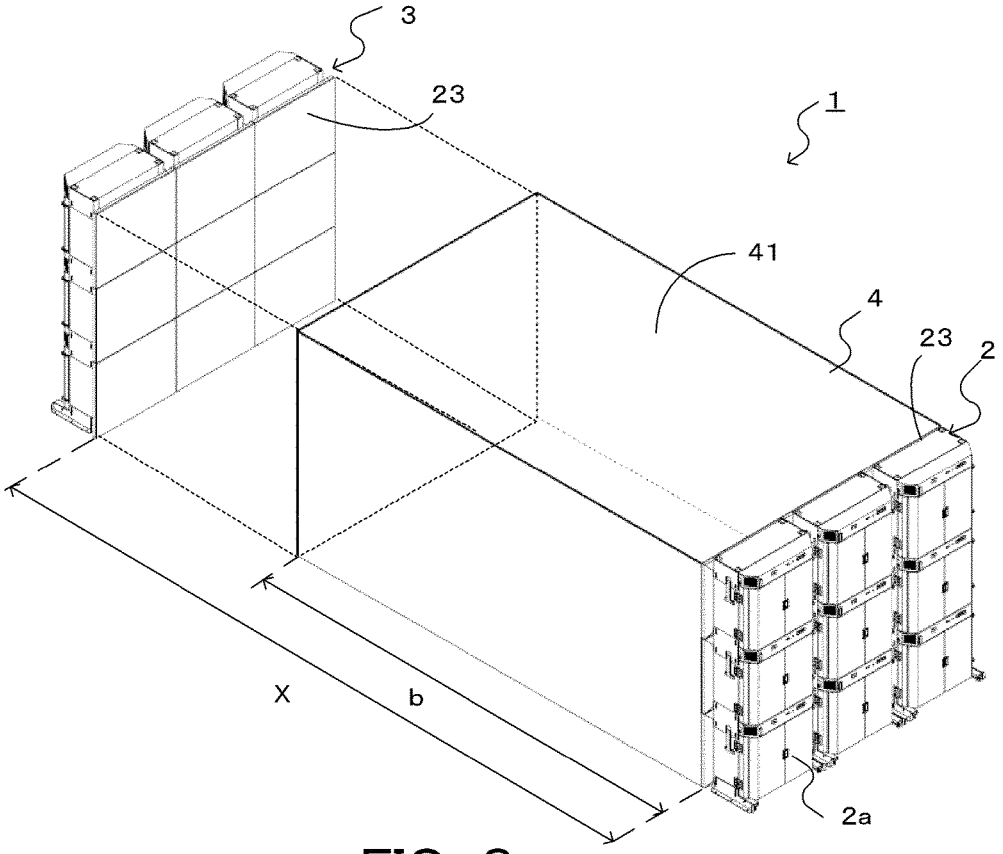
FIG. 8 is a view depicting a local air cleaning apparatus according to another embodiment of the invention.

In the above embodiment, the case in which the respective guides 4 and 5 are provided on the push hoods 2 and 3 has been exemplified to describe the present invention. However, for example, as depicted in FIG. 8, merely, the guide 4 may be provided on the push hood 2, and the guide 4 does not necessarily have to be provided on the push hood 3. Even in this case, the inside of the guide 4 and the open region between the opening face 41 and the air flow opening face 23 of the push hood 3 can have higher cleanliness than regions outside the local air cleaning apparatus 1, thus allowing the formation of a wide clean air space. Accordingly, in all embodiments, a guide may be provided on both of a pair of push hoods or on only one of the pair thereof.

Figure 9:
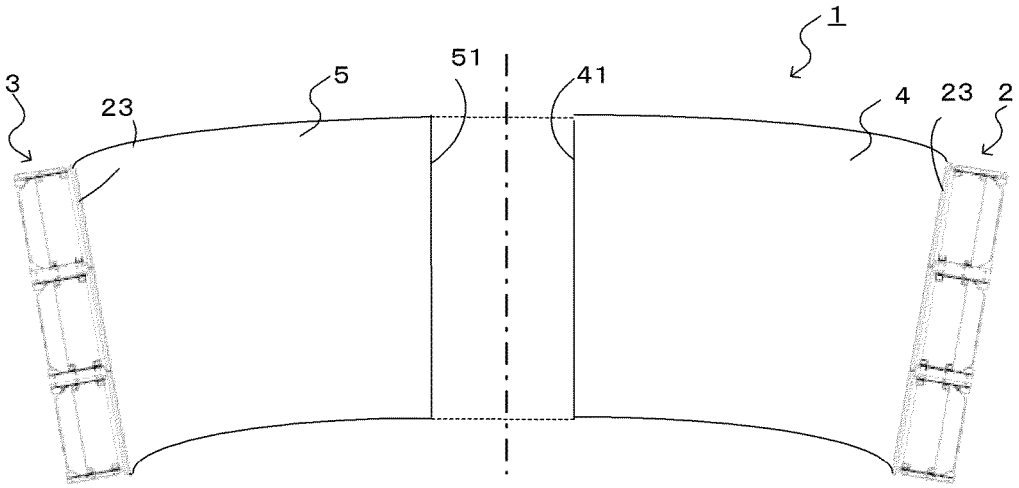
FIG. 9 is a view depicting a local air cleaning apparatus according to another embodiment.

The above embodiment has exemplified the case in which the shapes of the guides 4 and 5 continuing to the push hoods 2 and 3 are extended straightly from the air flow opening faces 23 of the push hoods 2 and 3 toward the opening faces 41 and 51 of the guides in order to describe the present invention. However, as depicted in FIG. 9, the shapes of the guides may be curved in a range maintaining the state of uniform air flows blown out from the air flow opening faces 23. Even in this case, the insides of the guides 4 and 5 and the open region between the opening faces 41 an 51 can have higher cleanliness than regions outside the local air cleaning apparatus 1, thus allowing the formation of a wide clean air space.

Figure 10:
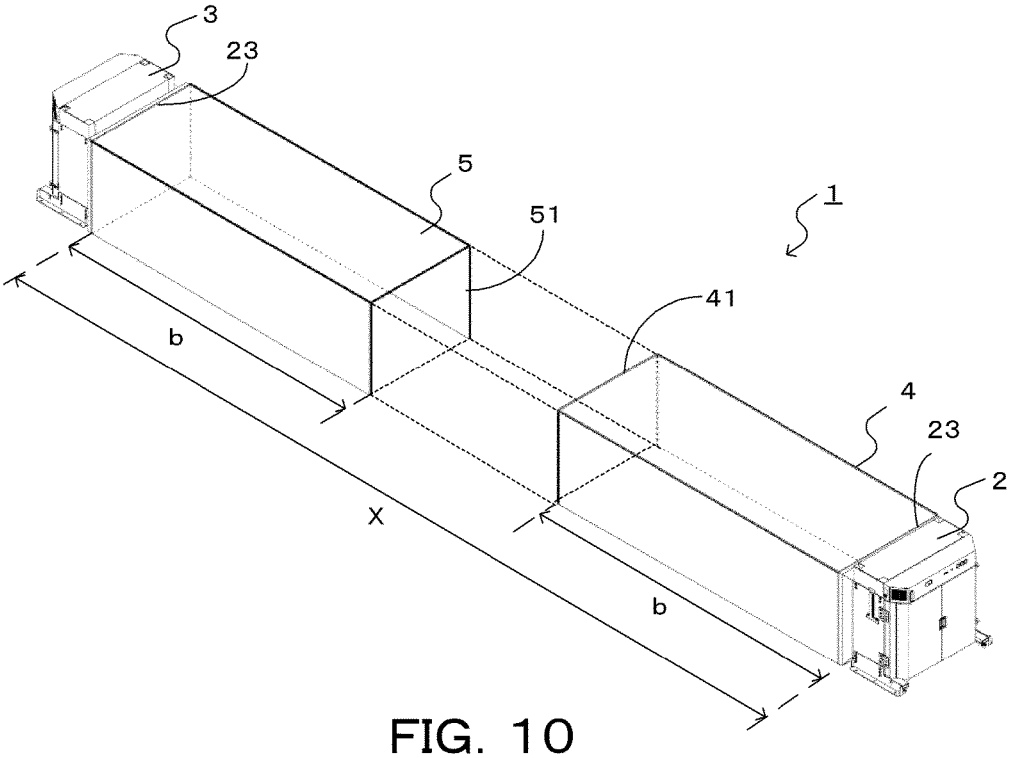
FIG. 10 is a view depicting a local air cleaning apparatus according to another embodiment.

In the above embodiment, the present invention has been described by exemplifying the case in which the push hoods 2 and 3, respectively, include respective nine (longitudinal three pieces×transversal three pieces) push hoods connected together by a connector. However, the number of push hoods forming each of the push hoods 2 and 3 may be either 10 or more or 8 or less. For example, the push hoods 2 and 3 may include respective four (longitudinal two pieces×transversal two pieces) push hoods connected together by a connector. In order to connect the push hoods like these examples, the push hoods are arranged such that the air flow opening faces of the push hoods are oriented in the same direction and short sides and long sides, respectively, of the push hoods are adjacent to each other. In this case, preferably, the mutual push hoods are connected together in such a manner that side faces, upper and lower faces, or both of the side faces and the upper and lower faces of the adjacent push hoods are in an airtight state, or the mutual push hoods are connected in an airtight state via a seal material such as a packing interposed between the side faces, the upper and lower faces, or both thereof of the adjacent push hoods. In addition, as depicted in FIG. 10, the push hoods 2 and 3, respectively, may comprise a single push hood. Even in these cases, the inside of the guide 4, the inside of the guide 5, and the open region between the opening faces 41 and 51 can have higher cleanliness than regions outside the local air cleaning apparatus 1, thus allowing the formation of a wide clean air space. Additionally, in the local air cleaning apparatus 1, without using a floor as one face of the guides 4 and 5, the shapes of the guides 4 and 5 may be made square and a work bench may be provided between the air flow opening faces 23.

Figure 11:
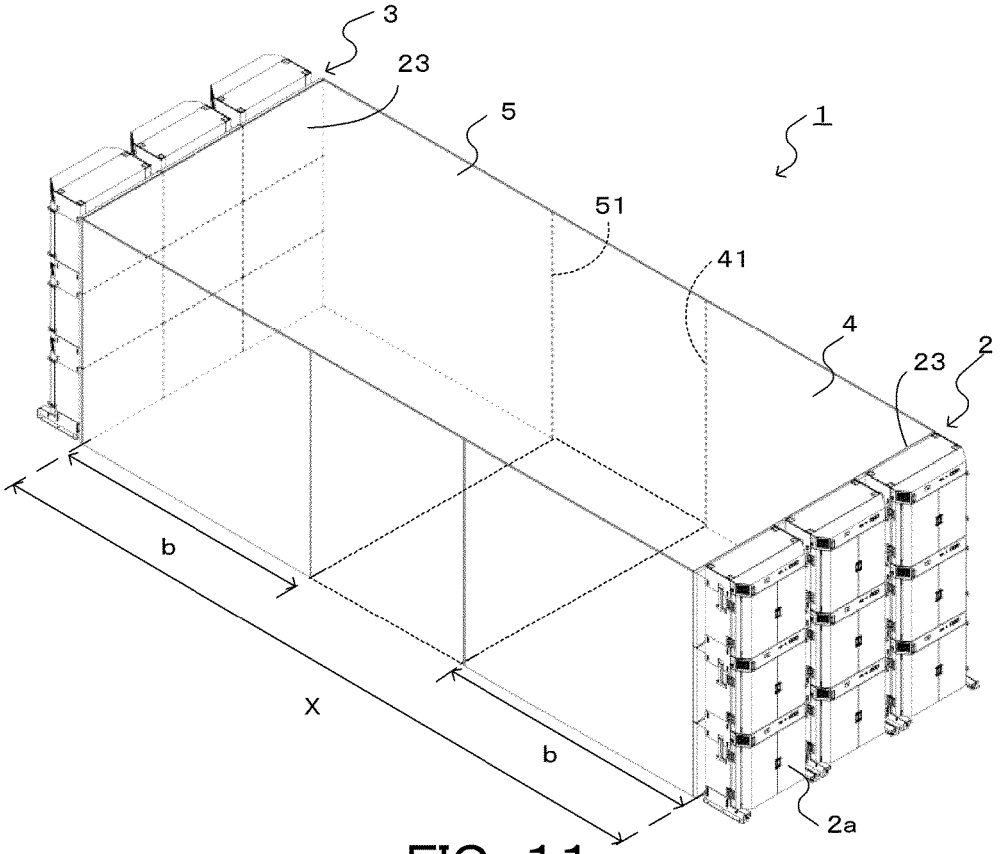
FIG. 11 is a view depicting a local air cleaning apparatus according to another embodiment.

The above embodiment has described the present invention by exemplifying the case in which, in the open region between the opening faces 41 and 51, the upper face and both side faces are open. However, for example, as depicted in FIG. 11, upper face end portions of the guides 4 and 5 may be connected to each other to form a region in which only side faces are open. Even in this case, the region between the air flow opening faces 23 can have higher cleanliness than regions outside the local air cleaning apparatus 1.

In addition, the push hoods 2 and 3 may have a structure with casters on the bottoms thereof. In this case, the push hoods 2 and 3 can be easily moved. Additionally, the guides 4 and 5 may be units of partitions with casters, which have a shape flexibly connectable to the push hoods 2 and 3, where the units may be covered with a vinyl sheet. In this case, construction work can be easy and movement of the units can also be easy. Furthermore, the guides 4 and 5 may be formed like a vinyl house extensible in a stream direction of an air flow in a shape of bellows. In this case, the lengths of the guides 4 and 5 can be easily changed, the guides 4 and 5 can be easily bent, and the positions of the guides 4 and 5, namely, a position for obtaining a clean space can be easily changed.

For example, when forming a clean zone in a corner of a room, a side wall face and/or the floor may be substituted for a part of the guides 4 and 5.

In addition, when a part of a conveyor-like line is arranged in a clean space, the part of the line intended to be cleaned may be entirely covered to be enclosed as in a tunnel; then, a push hood (2) may be attached so as to be connected to one end of the enclosed part of the line, whereas the other end thereof may be kept in an open state (opening face 41) to arrange the other push hood 3 at a position opposing the open end. In such an example, when the line is arranged along a wall, the wall can be substituted for a part of the guide 4.

EXAMPLES

Hereinafter, the present invention will be described in more detail with reference to specific Examples of the invention

Example 1

Figure 12:
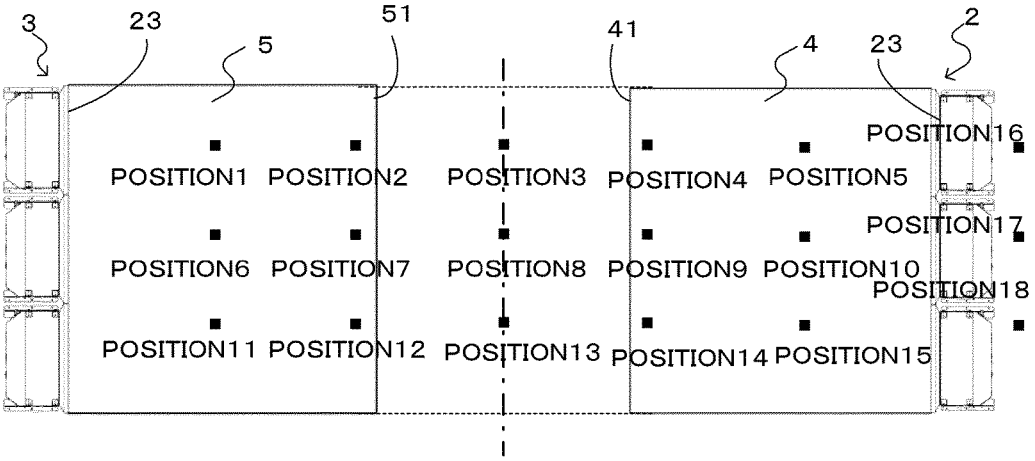
FIG. 12 is a view depicting measurement positions of Example 1.

Using the local air cleaning apparatus 1 depicted in FIG. 1, cleanliness was measured at measurement positions 1 to 15 (the insides of the guides 4 and 5 and the open region between the opening faces 41 and 51) depicted in FIG. 12. FIG. 12 is a top view of the local air cleaning apparatus 1. The push hoods 2 and 3, respectively, are formed by connecting nine push hoods (longitudinal three pieces× transversal three pieces) each having a width of 1050 mm and a height of 850 mm in such a manner that air flow opening faces of the push hoods are oriented in the same direction and short sides and long sides, respectively, of the push hoods are respectively arranged adjacent to each other. The respective opening faces have dimensions of a width of 3150 mm and a height of 2550 mm. The measurement height of the measurement positions 1 to 15 was at a position of ½ of the height of the push hoods 2 and 3. The measurement of cleanliness was performed using LASAIR-II manufactured by PMS Inc., to measure the number of dust particles (pieces/CF) having a particle size of 0.3 μm. Regarding cleanliness, cases with 300 pieces/CF or less were evaluated to be high in cleanliness. The length b of the guides 4 and 5, respectively, was 5 m, the distance X between the air flow opening face 23 of the push hood 2 and the air flow opening face 23 of the push hood 3 was 12 m, and the flow rate of a cleaned uniform air flow was 0.2 m/s. In addition, for reference, cleanliness was also similarly measured at measurement positions 16 to 18 outside the local air cleaning apparatus 1. Table 1 indicates the results.

TABLE 1

| Position | Number of Dust Particles (pieces/CF) |
|---|---|
| 1 | 0 |
| 2 | 0 |
| 3 | 0 |
| 4 | 0 |
| 5 | 0 |
| 6 | 0 |
| 7 | 0 |
| 8 | 2 |
| 9 | 1 |
| 10 | 0 |
| 11 | 1 |
| 12 | 1 |
| 13 | 2 |
| 14 | 0 |
| 15 | 0 |
| 16 | 1080000 |
| 17 | 1010000 |
| 18 | 1120000 |

As indicated in Table 1, it was able to be confirmed that the arrangement of the guides 4 and 5 allowed the inside of the guide 4, the inside of the guide 5, and the open region between the opening faces 41 and 51 to have higher cleanliness than the regions outside the local air cleaning apparatus 1.

Examples 2 to 6

Figures 13, 14:
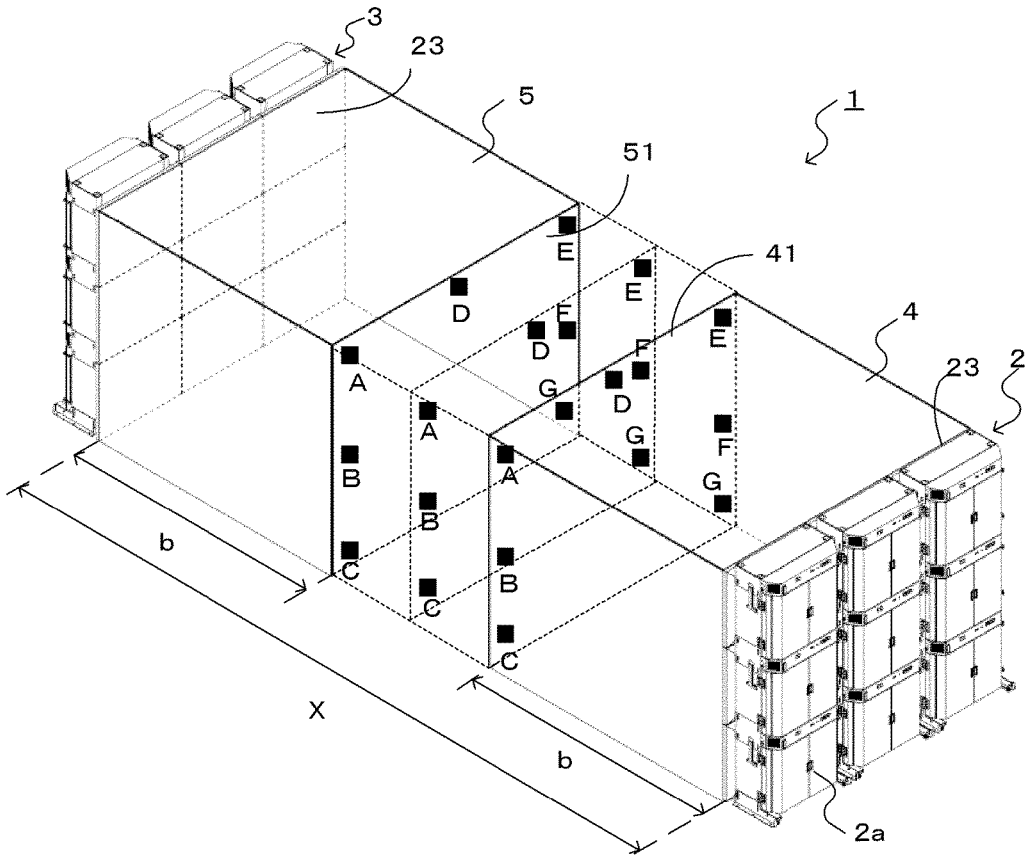
FIG. 13 is a view depicting conditions for Examples 2 to 6.
FIG. 14 is a view depicting measurement positions of Examples 2 to 6.

As depicted in FIG. 13, cleanliness was measured for cases of changing the flow rate of the cleaned uniform air flow and the length b of the guides 4 and 5. At that time, the distance X between the air flow opening face 23 of the push hood 2 and the air flow opening face 23 of the push hood 3 was set to 12 m, as in Example 1. In Example 1, the insides of the guides 4 and 5 were able to be confirmed to have been cleaned. Accordingly, in Examples 2 to 6, as depicted in FIG. 14, cleanliness was measured at seven points as respective measurement positions A to G in the opening face 41, in the opening face 51, and in the center between the opening faces 41 and 51, respectively. The results are given in Tables 2 to 6. The positions of measurement points A, D, and E were the positions of 15 cm downward from the upper edges of downstream end portions of the guides 4 and 5 and 15 cm inward of an air flow from the side edges of the downstream end portions of the guides. The positions of measurement points B and F were at an intermediate height between the upper edge and the lower edge of each of the downstream end portions of the guides 4 and 5 and at the positions of 15 cm inward of the air flow from the side edges of the downstream end portions of the guides. The positions of measurement points C and G were the positions of 15 cm upward in the guides from the lower edges of the downstream end portions of the guides 4 and 5 and 15 cm inward of the air flow from the side edges of the downstream end portions of the guides.

TABLE 2

| Measurement point | Number of dust particles (pieces/CF) Opening face 51 | Center | Opening face 41 |
|---|---|---|---|
| A | 0 | 0 | 3 |
| B | 2 | 6 | 78 |
| C | 2 | 3 | 24 |
| D | 0 | 9 | 10 |
| E | 1 | 0 | 0 |
| F | 5 | 3 | 3 |
| G | 7 | 15 | 130 |

TABLE 3

| Measurement point | Number of dust particles (pieces/CF) Opening face 51 | Center | Opening face 41 |
|---|---|---|---|
| A | 4 | 2 | 4 |
| B | 12 | 2 | 0 |
| C | 99 | 94 | 0 |
| D | 1 | 4 | 19 |
| E | 0 | 5 | 97 |
| F | 0 | 2 | 0 |
| G | 0 | 1 | 82 |

TABLE 4

| Measurement point | Number of dust particles (pieces/CF) Opening face 51 | Center | Opening face 41 |
|---|---|---|---|
| A | 96 | 0 | 61 |
| B | 0 | 0 | 32 |
| C | 8 | 38 | 6 |
| D | 0 | 0 | 0 |
| E | 128 | 2 | 18 |
| F | 0 | 0 | 0 |
| G | 1 | 4 | 8 |

TABLE 5

| Measurement point | Number of dust particles (pieces/CF) Opening face 51 | Center | Opening face 41 |
|---|---|---|---|
| A | 10 | 4 | 2 |
| B | 1 | 3 | 2 |
| C | 6 | 0 | 8 |
| D | 0 | 5 | 5 |
| E | 27 | 4 | 1 |
| F | 1 | 34 | 0 |
| G | 1 | 1 | 6 |

TABLE 6

| Measurement point | Number of dust particles (pieces/CF) Opening face 51 | Center | Opening face 41 |
|---|---|---|---|
| A | 1 | 6 | 60 |
| B | 54 | 2 | 3 |
| C | 32 | 1 | 2 |
| D | 25 | 15 | 8 |
| E | 2 | 9 | 1 |

TABLE 6-continued

| Measurement point | Number of dust particles (pieces/CF) Opening face 51 | Center | Opening face 41 |
|---|---|---|---|
| F | 2 | 6 | 3 |
| G | 22 | 2 | 39 |

As indicated in Tables 2 to 6, it was able to be confirmed that even when the flow rate of the cleaned uniform air flow and the length b of the guides 4 and 5 were changed, the arrangement of the guides 4 and 5 allowed the opening face 41, the opening face 51, and the open region between the opening faces 41 and 51 to have higher cleanliness than the regions outside the local air cleaning apparatus 1. In Example 3, it took 62 seconds to obtain the clean state.

Examples 7 and 8

In Example 7, cleanliness was measured in the same manner as Example 3, except that the distance between the opening faces 41 and 51 was 3.5 m, the length b of the guides 4 and 5 was 3.25 m, and the distance X between the air flow opening face 23 of the push hood 2 and the air flow opening face 23 of the push hood 3 was 10 m. In Example 8, cleanliness was measured in the same manner as Example 3, except that the distance between the opening faces 41 and 51 was 3.5 m and the distance X between the air flow opening face 23 of the push hood 2 and the air flow opening face 23 of the push hood 3 was 8 m. The results are given in Tables 7 and 8.

TABLE 7

| Measurement point | Number of dust particles (pieces/CF) Opening face 51 | Center | Opening face 41 |
|---|---|---|---|
| A | 7 | 1 | 0 |
| B | 11 | 2 | 0 |
| C | 2 | 2 | 0 |
| D | 0 | 1 | 0 |
| E | 3 | 0 | 4 |
| F | 1 | 3 | 0 |
| G | 7 | 2 | 3 |

TABLE 8

| Measurement point | Number of dust particles (pieces/CF) Opening face 51 | Center | Opening face 41 |
|---|---|---|---|
| A | 1 | 1 | 4 |
| B | 0 | 1 | 1 |
| C | 2 | 1 | 1 |
| D | 0 | 1 | 1 |
| E | 6 | 2 | 8 |
| F | 2 | 1 | 2 |
| G | 0 | 5 | 1 |

As indicated in Tables 7 and 8, it was able to be confirmed that even when the distance X between the air flow opening face 23 of the push hood 2 and the air flow opening face 23 of the push hood 3 was changed, the arrangement of the guides 4 and 5 allowed the opening face 41, the opening face 51, and the open region between the opening faces 41 and 51 to have higher cleanliness than the regions outside the local air cleaning apparatus 1.

Examples 9 and 10

In Example 9, cleanliness was measured in the same manner as Example 3, except for using the local air cleaning apparatus depicted in FIG. 10, in which the push hoods 2 and 3, respectively, comprised a single push hood, and setting the distance between the opening faces 41 and 51 to 1 m and the length b of the guides 4 and 5 to 5.5 m. In Example 10, cleanliness was measured in the same manner as Example 9, except for setting the distance between the opening faces 41 and 51 to 0.5 m, the length b of the guides 4 and 5 to 5.75 m, and the flow rate of the cleaned uniform air flow to 0.2 m/s. In addition, in Example 10, the measurement of cleanliness was performed only in the center between the opening faces 41 and 51. The results are given in Tables 9 and 10.

TABLE 9

| | Number of dust particles (pieces/CF) | | |
|---|---|---|---|
| Measurement point | Opening face 51 | Center | Opening face 41 |
| A | 3 | 1 | 5 |
| B | 20 | 5 | 10 |
| C | 162 | 1 | 42 |
| D | 1 | 1 | 6 |
| E | 1 | 2 | 5 |
| F | 34 | 1 | 68 |
| G | 16 | 54 | 1 |

TABLE 10

| | Number of dust particles (pieces/CF) | | |
|---|---|---|---|
| Measurement point | Opening face 51 | Center | Opening face 41 |
| A | | 2 | |
| B | | 15 | |
| C | | 2 | |
| D | | 2 | |
| E | | 0 | |
| F | | 12 | |
| G | | 0 | |

As indicated in Tables 9 and 10, it was able to be confirmed that even in the cases of using the local air cleaning apparatus including the push hoods 2 and 3 each comprising a single push hood depicted in FIG. 10, the arrangement of the guides 4 and 5 allowed the opening face 41, the opening face 51, and the open region between the opening faces 41 and 51 to have higher cleanliness than the regions outside the local air cleaning apparatus 1.

Examples 11 and 12

In Example 11, cleanliness was measured in the same manner as Example 3, except for using the local air cleaning apparatus depicted in FIG. 8 in which the guide 4 was provided only on the push hood 2 and setting the length b of the guide 4 to 9 m. In Example 12, cleanliness was measured in the same manner as Example 11, except for setting the length b of the guide 4 to 6.5 m. Measurement points were the same as those in Example 3. However, on the side of the apparatus having only the push hood, the measurement points were regarded as measurement points for a case of using the air flow opening face of the push hood 3 instead of the opening face 51, like the guide 5. The results are given in Tables 11 and 12.

TABLE 11

| | Number of dust particles (pieces/CF) | | |
|---|---|---|---|
| Measurement point | Air flow opening face 23 | Center | Opening face 41 |
| A | 0 | 0 | 0 |
| B | 15 | 1 | 1 |
| C | 196 | 1 | 2 |
| D | 0 | 1 | 1 |
| E | 0 | 1 | 1 |
| F | 0 | 0 | 0 |
| G | 0 | 2 | 6 |

TABLE 12

| | Number of dust particles (pieces/CF) | | |
|---|---|---|---|
| Measurement point | Air flow opening face 23 | Center | Opening face 41 |
| A | 0 | 257 | 0 |
| B | 0 | 298 | 0 |
| C | 0 | 294 | 0 |
| D | 0 | 107 | 0 |
| E | 0 | 61 | 3 |
| F | 0 | 210 | 2 |
| G | 0 | 242 | 72 |

As indicated in Tables 11 and 12, it was able to be confirmed that even in the case of using the local air cleaning apparatus in which the guide 4 was provided only on the push hood 2 depicted in FIG. 8, the arrangement of the guide 4 allowed the opening face 41, the air flow opening face 23 of the push hood 3, and the open region between the opening face 41 and the air flow opening face 23 of the push hood 3 to have higher cleanliness than the regions outside the local air cleaning apparatus 1.

Examples 13 and 14

In Example 13, cleanliness was measured in the same manner as Example 3, except for using the local air cleaning apparatus depicted in FIG. 5 in which the opening face 51 was enlarged to be larger than the opening face 41 and setting the distance between the opening faces 41 and 51 to 3 m and the length b of the guide 4 to 4.5 m. Regarding measurements points in this case, cleanliness in the center and the opening face 41 was measured at positions based on the guide with the opening face 41, and cleanliness in the opening face 51 was measured at positions based on the opening face 51. In Example 14, cleanliness was measured in the same manner as Example 3, except for using the local air cleaning apparatus depicted in FIG. 6 in which the opening face 51 was reduced in size to be smaller than the opening face 41 and setting the distance between the opening faces 41 and 51 to 3 m and the length b of the guide 4 to 4.5 m. Regarding measurement points in this case, cleanliness in the center and the opening face 41 was measured at positions based on the guide with the opening face 41, and cleanliness in the opening face 51 was measured at positions based on the opening face 51. The results are given in Tables 13 and 14.

TABLE 13

| Measurement point | Number of dust particles (pieces/CF) Opening face 51 | Center | Opening face 41 |
|---|---|---|---|
| A | 1 | 0 | 14 |
| B | 0 | 2 | 195 |
| C | 0 | 9 | 2 |
| D | 0 | 1 | 0 |
| E | 1 | 0 | 1 |
| F | 2 | 1 | 4 |
| G | 2 | 1 | 22 |

TABLE 14

| Measurement point | Number of dust particles (pieces/CF) Opening face 51 | Center | Opening face 41 |
|---|---|---|---|
| A | 10 | 1 | 0 |
| B | 0 | 1 | 3 |
| C | 1 | 1 | 0 |
| D | 0 | 0 | 0 |
| E | 0 | 5 | 1 |
| F | 118 | 3 | 0 |
| G | 109 | 1 | 0 |

As indicated in Tables 13 and 14, it was able to be confirmed that even in the cases of using the local air cleaning apparatus including the opening face 51 enlarged to be larger than the opening face 41 depicted in FIG. 5 and the local air cleaning apparatus including the opening face 51 reduced in size to be smaller than the opening face 41 depicted in FIG. 6, the arrangement of the guides 4 and 5 allowed the opening face 41, the opening face 51, and the open region between the opening faces 41 and 51 to have higher cleanliness than the regions outside the local air cleaning apparatus 1.

Example 15

In Example 15, cleanliness was measured in the same manner as Example 3, except for using a local air cleaning apparatus depicted in FIG. 11 in which the end portions of upper surfaces of the guides 4 and 5 were connected to form a region with only both side faces open and setting the length b of the guide 4 to 5 m and the flow rate to 0.2 m/s. The results are given in Table 15.

TABLE 15

| Measurement point | Number of dust particles (pieces/CF) Opening face 51 | Center | Opening face 41 |
|---|---|---|---|
| A | 10 | 0 | 20 |
| B | 0 | 0 | 0 |
| C | 15 | 0 | 0 |
| D | 0 | 0 | 0 |
| E | 12 | 0 | 20 |
| F | 10 | 0 | 0 |
| G | 0 | 27 | 30 |

As indicated in Table 15, it was able to be confirmed that even in the case of using the local air cleaning apparatus including the guides 4 and 5 whose upper surface end portions were connected to form the region with only both side faces open depicted in FIG. 11, the arrangement of the guides 4 and 5 allowed the opening face 41, the opening face 51, and the open region between the opening faces 41 and 51 to have higher cleanliness than the regions outside the local air cleaning apparatus 1.

Examples 1, 16, and 17

Regarding the case of Example 1, the flow rate of the cleaned uniform air flow was changed to 0.2 m/s, 0.3 m/s, and 0.5 m/s, respectively, to measure power consumption and noise in the center between the opening faces. In addition, the length b of the guide 4 in Example 1 was changed to 10 m (Example 16) and 20 m (Example 17), respectively, and the flow rate of the cleaned uniform air flow in Example 1 was changed to 0.2 m/s, 0.3 m/s, and 0.5 m/s, respectively, to similarly measure power consumption and noise in the center between the opening faces. The results are given in Table 16.

TABLE 16

| | Power consumption (W) | | | Noise level (dB) | | |
|---|---|---|---|---|---|---|
| | Flow rate 0.2 (m/s) | Flow rate 0.3 (m/s) | Flow rate 0.5 (m/s) | Flow rate 0.2 (m/s) | Flow rate 0.3 (m/s) | Flow rate 0.5 (m/s) |
| Example 1 | 2124 | 3402 | 7200 | 59.0 | 65.0 | 75.0 |
| Example 16 | | | | 56.0 | 61.7 | 70.4 |
| Example 17 | | | | 55.4 | 59.5 | 69.1 |

As indicated in Table 16, due to the changes of the flow rate of the uniform air flow to 0.2 to 0.5 m/s, the power consumption was changed to 2124 to 7200 W. In addition, due to the changes of the flow rate of the uniform air flow to 0.2 to 0.5 m/s, the noise level was changed to 59.0 to 75.0 dB(A) in Example 1, 56.0 to 70.4 dB(A) in Example 16, and 55.4 to 69.1 dB(A) in Example 17. Thus, it was able to be confirmed that the reduction in the flow rate of the uniform air flow reduced the power consumption and the noise level.

The present application is based on Japanese Patent Application No. 2011-152338 filed on Jul. 8, 2011 and Japanese Patent Application No. 2012-107029 filed on May 8, 2012, the entire specifications, claims, and drawings of which are incorporated herein by reference.

INDUSTRIAL APPLICABILITY

The present invention is useful for air cleaning in a local work space.

REFERENCE SIGNS LIST

1 Local air cleaning apparatus
2, 2*a*, 3 Push hood
4, 5 Guide
21 Housing
22 Air flow suction face
23 Air blowout face (Air flow opening face)
24 Air blowing mechanism
25 High performance filter
26 Rectification mechanism
27 Pre-filter
41, 51 Opening face

The invention claimed is:

1. A local air cleaning apparatus comprising:

a pair of push hoods each comprising an air flow opening face for blowing out a cleaned uniform air flow and a pair of guides each provided on a side of each of the push hoods, the guides being formed to cover outer peripheral outline portions of the air flow opening faces, each of the pair of guides extending from the side of the each push hood comprising the air flow opening face toward a downstream side of the uniform air flow to form an opening face at a downstream-side end portion of the each guide, wherein the pair of push hoods are arranged such that the respective air flow opening faces of the push hoods are opposed to each other;

the opening faces of the pair of guides are spaced apart from and opposed to each other so as to form an open region between the opening faces of the respective guides;

the cleaned uniform air flows blown out from the respective air flow opening faces collide with each other in the open region to flow out of the open region so as to cause the insides of the guides and the inside of the open region to be a work region having higher cleanliness, for an operator, than other regions; and the guides are configured to increase the work region while maintaining the higher cleanliness within the work region by enabling a distance between the air flow opening faces with having the guides to be greater than a distance therebetween without having the guides on the side of each of the air flow opening faces;

wherein the uniform air flow is blown out externally from the entire part of the air flow opening face in a direction substantially vertical to the air flow opening face; and the guides maintain a state of the uniform airflow blown out from the air flow opening face.

2. A local air cleaning apparatus comprising:

a pair of push hoods each comprising an air flow opening face for blowing out a cleaned uniform air flow and a guide provided on a side of one of the pair of push hoods, the guide being formed to cover outer peripheral outline portions of the air flow opening face, the guide extending from the side of the one push hood comprising the air flow opening face toward a downstream side of the uniform air flow to form an opening face at a downstream-side end portion of the guide, wherein the pair of push hoods are arranged such that the respective air flow opening faces of the push hoods are opposed to each other;

the opening face of the guide is spaced apart from and opposed to the air flow opening face of the other push hood not provided with the guide, so as to form an open region between the opening face of the guide and the air flow opening face of the push hood not provided with the guide;

the cleaned uniform air flows blown out from the respective air flow opening faces collide with each other in the open region to flow out of the open region so as to cause the inside of the guide and the inside of the open region to be a work region having higher cleanliness, for an operator, than other regions; and the guides are configured to increase the work region while maintaining the higher cleanliness within the work region by enabling a distance between the air flow opening faces with having the guides to be greater than a distance therebetween without having the guides on the side of each of the air flow opening faces;

wherein the uniform air flow is blown out externally from the entire part of the air flow opening face in a direction substantially vertical to the air flow opening face; and the guide maintains a state of the uniform airflow blown out from the air flow opening face.

3. The local air cleaning apparatus according to claim 1, wherein the respective opening faces of the guides are of substantially the same shape.

4. The local air cleaning apparatus according to claim 2, wherein the opening face of the guide and the air flow opening face of the push hood not provided with the guide are of substantially the same shape.

5. The local air cleaning apparatus according to claim 1, wherein the opening face of the guide and the air flow opening face of the push hood provided with the guide are of substantially the same shape.

6. The local air cleaning apparatus according to claim 1, wherein each of the pair of push hoods comprises a plurality of push hoods connected together.

7. The local air cleaning apparatus according to claim 1, wherein the cleaned uniform air flows blown out from the air flow opening faces have a flow rate of 0.2 to 0.7 m/s.

8. The local air cleaning apparatus according to claim 2, wherein the opening face of the guide and the air flow opening face of the push hood provided with the guide are of substantially the same shape.

9. The local air cleaning apparatus according to claim 2, wherein each of the pair of push hoods comprises a plurality of push hoods connected together.

10. The local air cleaning apparatus according to claim 2, wherein the cleaned uniform air flows blown out from the air flow opening faces have a flow rate of 0.2 to 0.7 m/s.

11. The local air cleaning apparatus according to claim 2, wherein the guides maintain a state of the uniform airflow blown out from the air flow opening face.

* * * * *